US008027224B2

(12) United States Patent
Brown et al.

(10) Patent No.: US 8,027,224 B2
(45) Date of Patent: Sep. 27, 2011

(54) BROADBAND UNDERWATER ACOUSTIC TRANSDUCER

(76) Inventors: David A. Brown, Barrington, RI (US); Boris Aronov, Newton, MA (US); Corey L. Bachand, New Bedford, MA (US)

( * ) Notice: Subject to any disclaimer, the term of this patent is extended or adjusted under 35 U.S.C. 154(b) by 0 days.

(21) Appl. No.: 12/616,254

(22) Filed: Nov. 11, 2009

(65) Prior Publication Data

US 2011/0110197 A1 May 12, 2011

(51) Int. Cl.
*H04R 17/00* (2006.01)

(52) U.S. Cl. ..... 367/153; 367/157

(58) Field of Classification Search ..... 367/151, 367/141, 173, 153, 155, 157
See application file for complete search history.

(56) References Cited

U.S. PATENT DOCUMENTS

| | | | | |
|---|---|---|---|---|
| 2,438,925 | A | 4/1948 | Krantz | |
| 2,438,927 | A * | 4/1948 | Emile et al. | 332/114 |
| 2,939,970 | A * | 6/1960 | Dranetz et al. | 310/371 |
| 4,209,766 | A * | 6/1980 | Teel | 367/155 |
| 4,439,847 | A * | 3/1984 | Massa | 367/151 |
| 4,916,675 | A * | 4/1990 | Hoering | 367/153 |
| 6,215,231 | B1 * | 4/2001 | Newnham et al. | 310/371 |
| 6,768,702 | B2 * | 7/2004 | Brown et al. | 367/151 |
| 2002/0159336 | A1 * | 10/2002 | Brown et al. | 367/138 |
| 2006/0079868 | A1 * | 4/2006 | Makin et al. | 606/27 |
| 2008/0008046 | A1 * | 1/2008 | Busch | 367/151 |

FOREIGN PATENT DOCUMENTS

EP 0413633 * 2/1991

OTHER PUBLICATIONS

Machine translation of EP 0413633.*

* cited by examiner

*Primary Examiner* — Dan Pihulic

(57) ABSTRACT

An efficient, broadband, underwater acoustic transducer having nominally a quasi-omnidirectional radiation pattern is realized with a plurality of thin walled radially vibrating hollow spherical piezoelectric transduction elements aligned axially. Each spherical transduction element is progressively smaller in diameter so as to enhance the combined frequency coverage and achieve the desirable radiation pattern. The transduction elements may be excited individually, or together electrically in series or in parallel combinations.

21 Claims, 2 Drawing Sheets

BROADBAND UNDERWATER ACOUSTIC TRANSDUCER

STATEMENT OF GOVERNMENT SUPPORT

This invention was made without government funding.

RELATED APPLICATION(S)

None.

FIELD OF THE INVENTION

The present invention relates to underwater acoustic transducers, more particularly, to broadband acoustic sources.

BACKGROUND OF THE INVENTION

Underwater acoustic transducers with wide bandwidth are desirable for underwater communication, sonar, or noise, signal-making and jamming applications. It is well known to those skilled in the art, that a broadband transducer may be achieved by a plurality of cylindrical transducers to cover a desired frequency range, however in comparison with the subject approach, the former broadband transducers provide outward radiation that is largely directional.

Many broadband electroacoustic transducers have been described using a plurality of cylindrical ring transducers elements each having different resonance frequencies to achieve a broadband coverage. For example, U.S. Pat. No. 2,439,927 by Krantz describes a plurality of magnetostrictive cylindrical transducers aligned coaxially in decreasing size. Such an approach employing cylindrical piezoelectric ceramic elements is common today to those skilled in the art whereby a sound is radiated predominantly in a direction radially outward to achieve an omnidirectional radiation in one plane. Such a beam pattern maybe considered toroidal in shape. U.S. Pat. No. 4,916,675 by Hoering also describes a broadband acoustic transducer by using a plurality of transducer rings although of the same diameter each having different resonance frequencies. U.S. Pat. No. 4,439,847 by Massa describes a means to achieve a broadband electroacoustic transducer employing a plurality of cylindrical transduction elements whereby the use of reflectors causes the primary radiation to be directed on axis of comprising coaxial elements. Such a beam may be described as conical. U.S. Pat. No. 6,215,231 by Newnham et al. describes an electroactive ceramic hollow sphere having access holes to enable the passage of instrumentality. U.S. Pat. No. 6,768,702 by Brown and Aronov describes a method for obtaining broader bandwidth directional electroacoustics transducers by combining the use of multimode excitation of cylinders (or spheres) with conformal acoustic baffles.

SUMMARY OF THE INVENTION

This subject invention relates to electroacoustic transducers and more specifically with extending the bandwidth of an underwater transmitting transducer. In the preferred embodiment, the electroacoustic transducer is comprised of a plurality of hollow spherical transduction elements each producing more omnidirectional and uniform radiation patterns. Radially polarized spherical piezoceramic elements have relatively high effective electromechanical coupling coefficients resulting in broad bandwidth.

An efficient, broadband, underwater acoustic transducer having nominally a quasi-omnidirectional radiation pattern is realized with an electrical connection of a plurality of thin-walled radially vibrating spherical piezoelectric transduction elements aligned axially. Each spherical transduction element is progressively smaller in diameter so as to enhance the combined frequency coverage and to provide a means for sufficient separation of elements to promote radiation.

Each spherical transducer element is progressively smaller in diameter so that when enclosed in a suitable housing or encapsulation, the broadband transducer takes on a streamlined or hydrodynamic shape so that it may become the nose of a small diameter underwater vehicle.

According to the method embodiments of the present invention, the resulting transducer may be encapsulated in a suitable hydrodynamic shape and have means for its connection through a suitable base structure for attachment to a suitable platform.

A further object of the invention is to encapsulate the above described multi-element transducer array within a hydrodynamic or streamlined molded shape of sound transmitting material to allow sound transmission to the surrounding immersion fluid.

Another object of this invention is to produce a broadband underwater transducer that has high efficiency over a wide frequency band as great as one or two octaves for operating above the frequency range of about 5 kHz.

Another object of the invention is to utilize thin-walled hollow piezoelectric spherical elements having a wall thickness of the order 10+/−5% of their radii in order to achieve a wide bandwidth for each element in the array.

According to method embodiments of the present invention, a method of electrical connection is described to allow individual elements to be excited or combinations of said elements to be excited simultaneously.

According to method embodiments of the present invention, individual elements may be selectively excited in particular fundamental lower order modes of extensional vibration or combinations thereof.

According to method embodiments of the present invention, the broadband transducer consisting of multiple thin walled hollow piezoelectric spherical elements, can be encapsulated as a single structure and made electrically insulated from the fluid of immersion by suitable encapsulation, molding, or containment.

According to the method embodiments the broadband transducer attached to said suitable platform may be in the form of a mobile submersible vehicle where said combination of broadband transducer forms a means for providing broadband acoustic communications, broadband sonar, or broadband acoustic signaling or interference.

According to the method embodiments said broadband transducer operating as said countermeasure may faithfully convert suitable electrical signals of deterministic, random, continuous, pulsed, discrete origin into acoustic signals in the medium in which it is immersed.

According to the method embodiments individual thin-walled hollow spherical piezoelectric elements may be substituted with thin-walled hollow cylindrical piezoelectric elements, so that said broadband transducer consists of a compact combination of spherical and cylindrical radiators.

According to the method embodiments said broadband transducer may be operated in transmit, receive or simultaneously in duplex modes of operation.

According to the method embodiments said broadband transducer comprised of individual spherical and/or cylindrical elements may have holes in the distal polar surfaces to permit the passage of a tube, said tube permitting the passage of a propeller shaft to provide means for propulsion.

According to the method embodiments said broadband transducer comprised of individual spherical and/or cylindrical elements may have means to permit the interior of the hollow spherical or cylindrical transduction elements to be used for housing accompanying electronics and/or inductive tuning elements.

Further features, advantages and details of the present invention will be appreciated by those of ordinary skill in the art from a review of the figures and a careful reading of the detailed description of the preferred embodiments that follow, such description being merely illustrative of the present invention.

DETAILED DESCRIPTION OF EMBODIMENTS OF THE INVENTION

The present invention now will be described more fully hereinafter with reference to the accompanying drawings to fully convey the scope of the invention to those skilled in the art.

Figure 1:
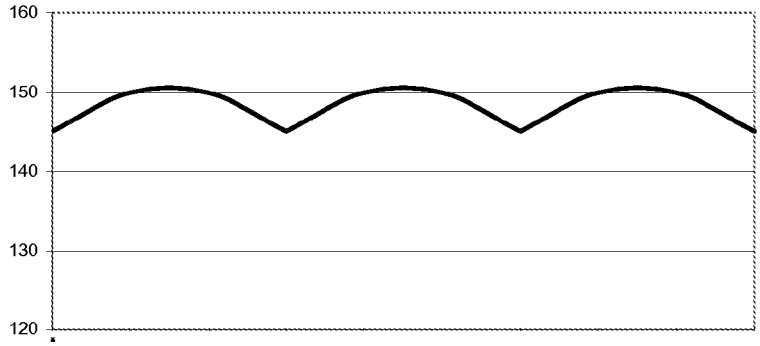
FIG. 1 is a frequency response curve showing the transmit pressure per unit voltage response as a function of frequency for a broadband transducer consisting of three electroacoustic transduction elements.

In FIG. 1, the transmit pressure response per unit applied voltage or so called TVR of the broadband acoustic transducers is shown comprised of the response of a plurality of electroacoustic transduction elements so aligned in frequency space as to provide a suitable coverage over a broad range of frequencies. Each response curve labeled as 1A, 1B, 1C corresponds with the response from an individual electroacoustic transduction element. The numbers on the ordinate are arbitrarily chosen. The horizontal ordinate depicting frequency is presented in a logarithmic scale. The transducer elements are designed to have resonance frequencies and quality factors to provide broad frequency coverage.

Figure 2:
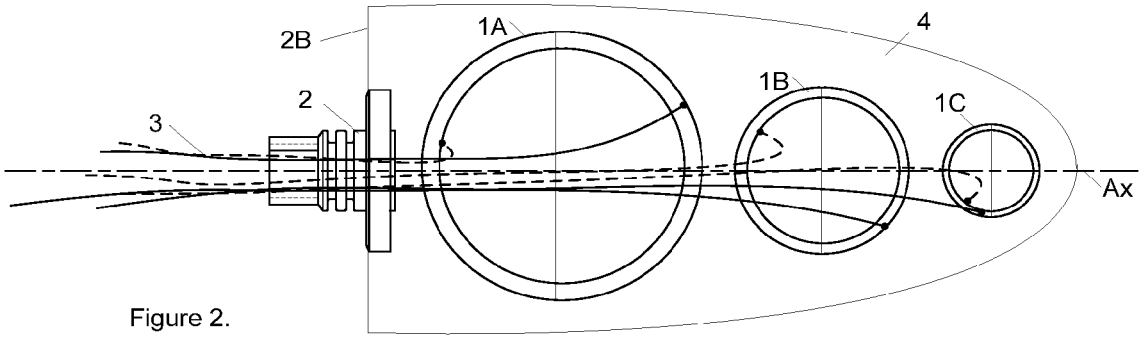
FIG. 2 is an illustration, cross-sectional view, of an embodiment of the broadband transducer consisting of a plurality (three shown) hollow spherical elements aligned in relation to an axis of rotational symmetry.

In FIG. 2, a broadband acoustic transducer is realized by the combination of a plurality of hollow spherical transduction elements (three are shown and labeled as 1A, 1B, 1C). The broadband acoustic transducer may include a provision to include a suitable mounting fixture 2 that is attached to a base 2B and permits the passage of electrical wiring 3 which are in turn connected to electroded surfaces of the individual transduction elements. The broadband acoustic transducer is operable underwater by the addition of a suitable encapsulation, molding, or enclosure as shown by element 4, said element may take the form of a streamlined or hydrodynamic shape to reduce drag forces when operated in the immersion fluid while moving. The individual transduction elements may be connected electrically in parallel or series or remain separately selectable.

In general, the broadband acoustic transducer in FIGS. 2, 3, 4, 5, 6 can be deployed in a body of water and submerged to great depth due to the strength of the spherical or cylindrical bodies. The broadband acoustic transducer may be attached to a suitable vehicle to provide a suitable means of propulsion and movement at speed and depth. The encapsulated body 4 may also serve to protect the individual transduction elements. The hollow spherical transduction elements (1A, 1B, 1C) may be individually comprised of hollow hemispherical elements glued together by suitable means or other suitable means known to those skilled in the art. The broadband acoustic transducer device may be realized with two or more separate transduction elements. Each individual transduction element may be further wired in a manner to selectively excite a particular mode of vibration.

Figure 3:
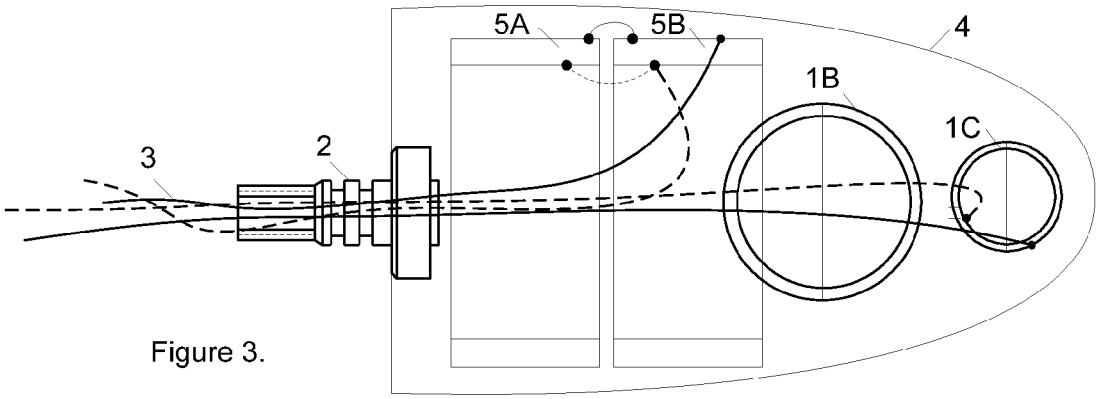
FIG. 3 is an illustration, cross-sectional view, of an embodiment of the broadband transducer comprising both hollow spherical elements and hollow cylindrical transduction elements, said elements in axial alignment, with said cylindrical elements at the base of the broadband transducer and with said spherical elements at the apex of said broadband transducer.
Figure 4:
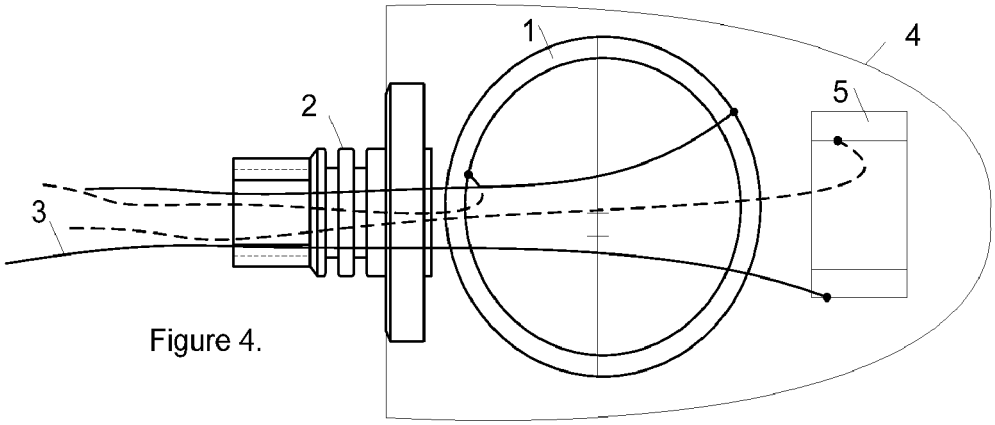
FIG. 4 is an illustration, cross-sectional view, of an embodiment of the broadband transducer comprising both hollow spherical elements and hollow cylindrical transduction elements, said elements in axial alignment, with said cylindrical element(s) at the apex of the broadband transducer and with said spherical element(s) at the base of said broadband transducer.

In some embodiments, as shown in FIG. 3, the broadband acoustic transducer may employ a single or multiple cylindrical transduction element (5A, 5B) in place of one or more hollow spherical transduction elements. In some embodiments the hollow spherical element may be closely aligned or partially contained by the hollow cylindrical element in order to realize a more compact structure.

Still in other variants the hollow spherical element may be located at the base of said broadband acoustic transducers in relation to a cylindrical element that is at the opposing end to achieve a compact device and form factor.

Figure 5:
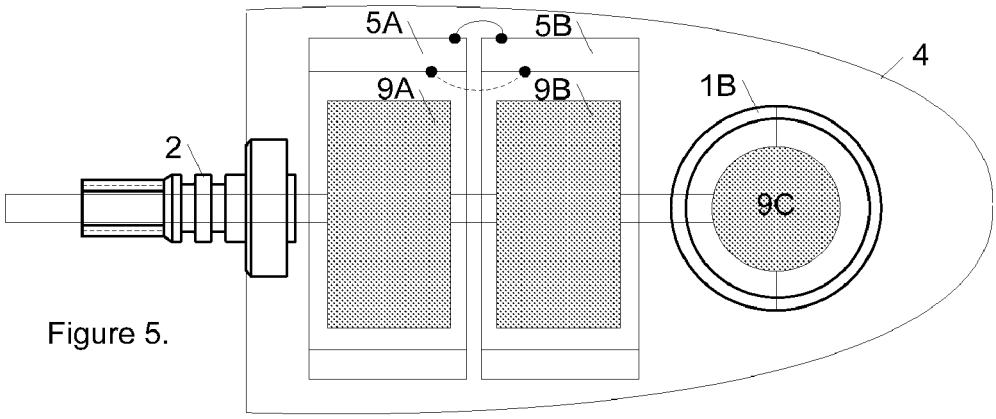
FIG. 5 is an illustration, cross-sectional view, of the broadband transducer wherein a means for including accompanying electronics and/or tuning elements in the interior of said transduction elements.

In some embodiments, as shown in FIG. 5, a means exists to allow associated electronics or tuning elements (9A, 9B, 9C) to be contained within corresponding transduction elements for either the cylindrical (5A, 5B) or spherical (1B) type.

Figure 6:
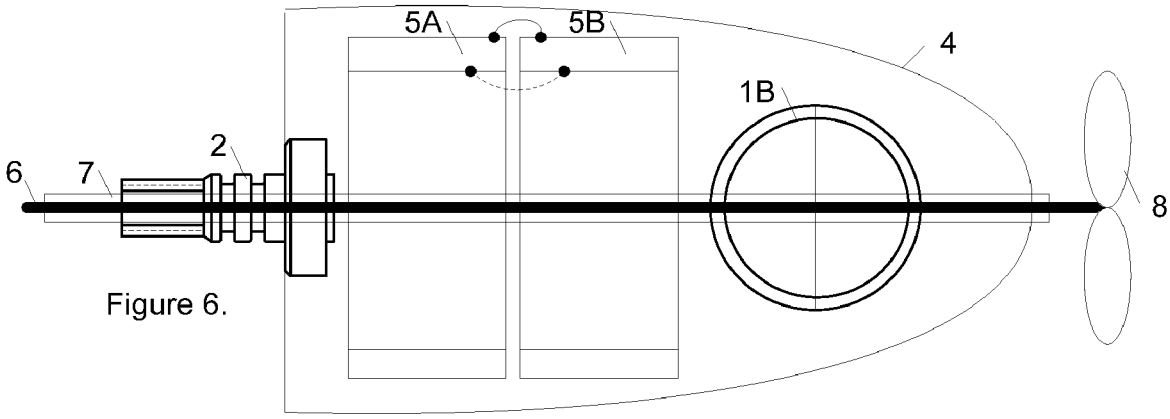
FIG. 6 is an illustration, cross sectional view, of an embodiment of the broadband transducer with provisional means to include a propulsion shaft permitted to pass through the transducer.

In some embodiments, as shown in FIG. 6, a means exists to allow the passage of an axisymmetric tube (7) permitting the passage of a propeller shaft (6) suitably sealed, which may in turn be connected to a propeller (8) to allow propulsion of said broadband acoustic transducer in conjunction with elements of an underwater vehicle.

We claim:

1. A broadband electroacoustic transducer for producing broadband sound in a fluid medium, comprising a plurality of hollow spherical piezoelectric elements, said elements having different fundamental resonance frequencies as a result of different dimensions and/or different materials, said elements being aligned along an axis of rotational symmetry, whereby said elements produce surface vibrations causing inherent axisymmetric acoustic radiation.

2. The broadband electroacoustic transducer of claim 1 wherein the hollow spherical piezoelectric elements are encapsulated, molded, or booted so as to permit operation in the fluid medium.

3. The broadband electroacoustic transducer of claim 1 wherein said broadband transducer is encapsulated, molded, or booted in a axisymmetric hydrodynamic shaped body, said hydrodynamic shaped body having a smooth, continuous, and monotonically decreasing diameter from a circular base nearest to a circular apex, said hydrodynamic shaped body serving to reduce drag forces when said transducer is moving through said fluid medium.

4. The broadband electroacoustic transducer of any of claims 1-3, wherein said transducer is connected to supporting functional electronics to realize operation as a broadband communication device, and further comprising a base for mounting to a cylindrical housing, said housing containing supporting electrical elements.

5. The broadband electroacoustic transducer of claim 1, wherein said transducer is connected to supporting electrical elements to realize operation as an acoustic source or receiver, said source capable of producing signals that communicate or interfere with other devices submerged in the fluid medium.

6. The broadband electroacoustic transducer of claim 1 wherein said transducer is attached and electrically connected to a mobile device with means for propulsion in the fluid medium.

7. The broadband electroacoustic transducer of claim 1 wherein a first access hole is on one pole of the spherical elements and a second access hole in the opposing pole of the spherical elements and thereby made to permit the passage of a propeller shaft for propulsion.

8. The broadband electroacoustic transducer of claim 1 wherein said elements are electrically connected individually, electrically in series, or electrically in parallel with provisions for connection to additional electrical or magnetic elements.

9. The broadband electroacoustic transducer of claim 1, wherein the inner and outer surfaces of said hollow spherical elements are electroded, said inner and outer electroded surfaces are further divided and separated, wherein said divided electrode surfaces are electrically energized in order to excite a higher order mode or combination of modes of vibration.

10. The broadband electroacoustic transducer of claim 1, wherein the inner and outer surfaces of said hollow spherical electroacoustic elements are electroded, wherein said inner and outer surfaces are further divided in halves, said halves separated at the equator, wherein a means exists for selectively exciting said electroacoustic transducer elements in modes of vibration or their combination by selecting the amplitude and relative phase or polarity of electrical signals supplied to each hemispherical part, thereby selectively exciting corresponding modes of vibration in the hollow spherical elements, the lowest mode of vibration corresponding to the uniform breathing mode and the next lowest mode of vibration corresponding to cosinusoidal distribution of radial vibrations, wherein said spherical elements include a conformal baffle on a part of their surface to reduce radiation in a particular direction.

11. The broadband electroacoustic transducer of claim 1, wherein said hollow spherical piezoelectric elements are acoustically baffled on a hemispherical part of the outer surface.

12. A broadband electroacoustic transducer for operation in a fluid medium, comprising individual transduction elements, at least one of said elements is a hollow spherical piezoelectric element, and at least one of said elements is a hollow cylindrical piezoelectric element, the spherical element having a smaller diameter than the diameter of said cylindrical element, said elements are aligned asymmetrically, said cylindrical element or elements each having a height-to-radius ratio less than unity in order to produce acoustic radiation in both the direction of the axis of symmetry and simultaneously in the direction perpendicular to said axis of symmetry, wherein the largest of said cylindrical elements having the lowest resonance frequency is arranged closest to a base.

13. The broadband electroacoustic transducer of claim 1 or claim 12 further comprising a passage to permit passage of a propeller shaft for propulsion.

14. A broadband acoustic transducer consisting of a plurality of cylindrical-shell transduction elements where a provision is made to permit the passage of a propeller shaft for means of propulsion.

15. The broadband electroacoustic transducer of claim 1 or 12 further including electrical tuning or amplifier elements inside any of the electroacoustic elements in order to conserve space.

16. The broadband electroacoustic transducer of claim 1 wherein said transducer is made near neutrally buoyant in said fluid medium by design considerations of the presence of the hollow spherical piezoelectric elements or additional voided cavities.

17. The broadband electroacoustic transducer of claim 1 said elements each comprising a piezoelectric ceramic material, said material being polarized, said spherical piezoelectric elements having different fundamental natural resonant frequencies corresponding to modes of vibrations that are substantially uniform, said elements being coaxially aligned, a single line connecting the centers of said spherical elements forms an axis of rotational symmetry, wherein the inner surface and the exterior surface of said elements each have a conducting surface, said electrode surfaces are separated by the thickness of said spherical elements, whereby said spherical elements produce vibrations causing axisymmetric acoustic radiation, said electrode-surfaces on each of said spherical elements having attached electrical wires, whereby a voltage potential across said thickness of said elements induces mechanical vibration, which in turn produces acoustic radiation in said fluid.

18. The broadband electroacoustic transducer of claims 5 or 6 wherein a second broadband electroacoustic transducer is connected to the opposite end of a suitable housing.

19. The broadband electroacoustic transducer of claim 1 wherein at least one of the hollow spherical elements is realized by joining two hollow hemispherical piezoelectric elements.

20. The electroacoustic transducer of claim 4, wherein said base is axisymmetric and has a tapered side, gradually becoming smaller in diameter, said tapered side being closer to the largest of said hollow spherical elements, said tapered side serving to reduce acoustical interactions of said hollow spherical elements and said base.

21. The broadband electroacoustic transducer of claim 1 wherein at least one hollow spherical element has at least one circular opening at a pole.

* * * * *